US009020370B2

(12) United States Patent
Itabashi et al.

(10) Patent No.: US 9,020,370 B2
(45) Date of Patent: Apr. 28, 2015

(54) IMAGE FORMING APPARATUS CAPABLE OF DETERMINING TYPE OF CARTRIDGE MOUNTED THEREIN BASED ON DETECTION OF A DETECTION PORTION OF THE CARTRIDGE

(71) Applicants: Nao Itabashi, Nagoya (JP); Tetsuya Okano, Anjo (JP)

(72) Inventors: Nao Itabashi, Nagoya (JP); Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 54 days.

(21) Appl. No.: 13/832,113

(22) Filed: Mar. 15, 2013

(65) Prior Publication Data

US 2013/0287411 A1 Oct. 31, 2013

(30) Foreign Application Priority Data

Apr. 27, 2012 (JP) ..... 2012-103439

(51) Int. Cl.
*G03G 15/00* (2006.01)
*G03G 15/08* (2006.01)

(52) U.S. Cl.
CPC ..... *G03G 15/0831* (2013.01); *G03G 15/0863* (2013.01)

(58) Field of Classification Search
USPC ..... 399/12
See application file for complete search history.

(56) References Cited

U.S. PATENT DOCUMENTS 7,428,387 B2 * 9/2008 Arakawa ..... 399/12
7,970,293 B2 * 6/2011 Ishikawa et al. ..... 399/12
8,009,996 B2 * 8/2011 Ishikawa ..... 399/12

FOREIGN PATENT DOCUMENTS

JP 2007-328305 A 12/2007
JP 2009-244564 A 10/2009

OTHER PUBLICATIONS

Computer translation JP2009-244564A, published Oct. 2009 to Hiroshi et al.*

* cited by examiner

*Primary Examiner* — Quana M Grainger
(74) *Attorney, Agent, or Firm* — Banner & Witcoff, Ltd.

(57) ABSTRACT

An image forming apparatus includes: a cartridge; a drive source; a detection unit; and a control device. The cartridge includes a movable member provided with a detected portion and configured to move by a predetermined moving amount. The drive source generates a rotation as a drive force and transmits the drive force to the movable member. The drive source includes a rotation amount detection unit that detects a rotation amount of the drive source and outputs a first detection result. The detection unit detects the detected portion and outputs a second detection result. The control device executes: a calculation process configured to calculate the rotation amount of the drive source during a time period of detecting the detected portion based on the first detection result and the second detection result; and a cartridge type determination process configured to determine a type of the cartridge based on the calculated rotation amount.

16 Claims, 8 Drawing Sheets

IMAGE FORMING APPARATUS CAPABLE OF DETERMINING TYPE OF CARTRIDGE MOUNTED THEREIN BASED ON DETECTION OF A DETECTION PORTION OF THE CARTRIDGE

CROSS REFERENCE TO RELATED APPLICATION

This application claims priority from Japanese Patent Application No. 2012-103439 filed Apr. 27, 2012. The entire content of the priority application is incorporated herein by reference.

TECHNICAL FIELD

The present invention relates to an image forming apparatus capable of determining a type of a cartridge mounted therein.

BACKGROUND

There is conventionally known an image forming apparatus capable of determining a type of a cartridge detachably mounted in a main casing of the image forming apparatus. More specifically, the cartridge has a casing for accommodating developer therein, a rotating body mounted in the casing and rotatable upon receipt of a drive force from a drive source, and a detection protrusion provided at a part of the rotating body. The detection protrusion has a length in a rotating direction that differs depending on a capacity of the casing. On the other hand, the main casing has a detection actuator and an optical sensor that detect the detection protrusion during rotation of the rotating body.

In this image forming apparatus, when the cartridge is mounted in the main casing and then, for example, a front cover is closed, a warming-up operation (idle rotation) is executed by a control device. Here, the idle rotation means an operation that rotates an agitation member in the cartridge so as to agitate the developer in the cartridge.

In such an idle rotation, a drive force is transmitted to the rotating body from a motor drive source provided in the main casing to cause the rotating body to rotate by a predetermined amount. The control device determines a type of the cartridge based on a length of time during which the detection actuator and the optical sensor detect the detection protrusion.

SUMMARY

However, in the above-descried technique, when the detection protrusion is designed to be detected during motor acceleration, there can be a variation in the detection time length due to a variation in the motor acceleration which can occur depending on the use environment of the image forming apparatus even if the detection protrusion having the same length in the rotation direction is detected. Thus, the type of the cartridge cannot be determined correctly. In this case, therefore, the detection protrusion needs to be detected after elapse of a predetermined time from a start of the motor drive to a time at which a rotating speed of the motor becomes constant, which disadvantageously increases the time required for the type of the cartridge to be determined.

In view of the foregoing, it is an object of the present invention to provide an image forming apparatus capable of reducing the time required for the cartridge type to be determined.

In order to attain the above and other objects, the present invention provides an image forming apparatus including: a cartridge; a drive source; a detection unit; and a control device. The cartridge includes a movable member provided with a detected portion. The movable member is configured to move by a predetermined moving amount. The drive source is configured to generate a rotation as a drive force and configured to transmit the drive force to the movable member. The drive source includes a rotation amount detection unit configured to detect a rotation amount of the drive source and configured to output a first detection result. The detection unit is configured to detect the detected portion and configured to output a second detection result. The control device is configured to execute: a calculation process configured to calculate the rotation amount of the drive source during a time period of detecting the detected portion based on the first detection result and the second detection result; and a cartridge type determination process configured to determine a type of the cartridge based on the calculated rotation amount.

According to another aspect, the present invention provides an image forming apparatus including: a cartridge; a drive source; a detection unit; a rotation amount detection unit; and a control device. The cartridge includes a movable member provided with a detected portion. The movable member is configured to move by a predetermined moving amount. The drive source is configured to generate a rotation as a drive force and configured to transmit the drive force to the movable member. The detection unit is configured to detect the detected portion and configured to output a first detection result. The rotation amount detection unit is configured to detect a rotation amount of the drive source and configured to output a second detection result. The control device is configured to execute: a calculation process configured to calculate the rotation amount of the drive source during a time period of detecting the detected portion based on the first detection result and the second detection result; and a cartridge type determination process configured to determine a type of the cartridge based on the calculated rotation amount.

BRIEF DESCRIPTION OF THE DRAWINGS

In the drawings;

FIGS. 4A through 4C are explanatory views illustrating an operation of a rotatable body, in which FIG. 4A shows a relationship between the rotatable body and a detection arm when the developing cartridge is mounted in a main casing of the laser printer; FIG. 4B shows a state where an idle rotation is started; and FIG. 4C shows a state where the detection arm that has been supported by a detection protrusion of the rotatable body is away from the detection protrusion;

FIGS. 6A and 6B are explanatory views showing a rotating speed of a motor, an ON/OFF state of an optical sensor and an output of a plurality of hall elements at the time of the idle rotation, in which FIG. 6A shows a case where the developing cartridge with a large capacity is mounted in the main casing of the laser printer; and FIG. 6B shows a case where the developing cartridge with a small capacity is mounted in the main casing of the laser printer;

DETAILED DESCRIPTION

A laser printer as an image forming apparatus according to one embodiment of the present invention will be described with reference to FIGS. 1 through 7. Throughout the specification, the terms "upward", "downward", "upper", "lower", "above", "below", "beneath", "right", "left", "front", "rear" and the like will be used assuming that the laser printer 1 is disposed in an orientation in which it is intended to be used. More specifically, in FIG. 1 a left side and a right side are a rear side and a front side, respectively. Further, in FIG. 1 a near side and a far side are a left side and a right side, respectively. Further, in FIG. 1 a top side and a bottom side are a top side and a bottom side, respectively.

<Overall Configuration of Laser Printer>

Figure 1:
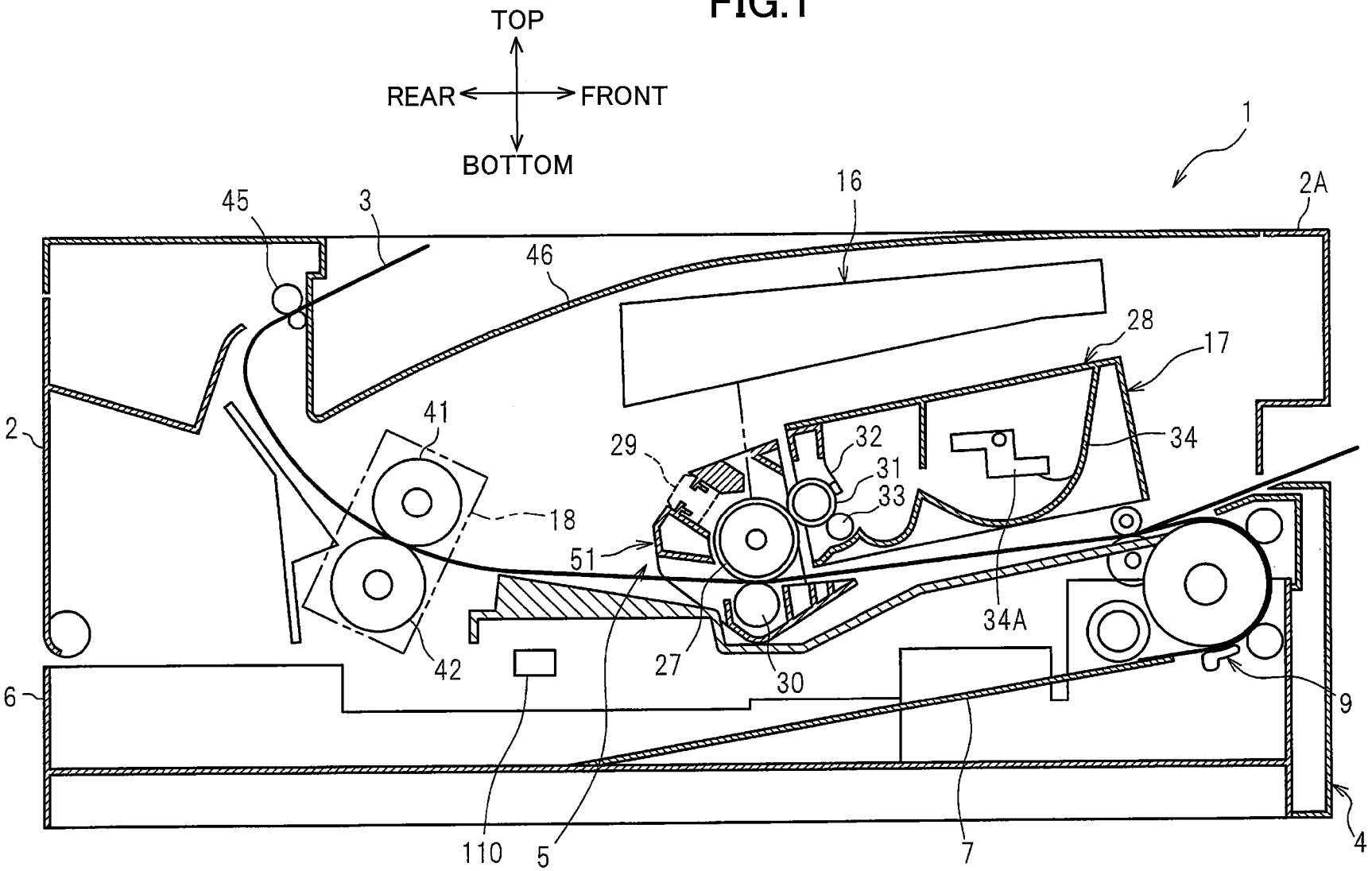
FIG. 1 is a schematic cross-sectional view of a laser printer according to one embodiment of the present invention.

As illustrated in FIG. 1, the laser printer 1 includes a main casing 2, and within the main casing 2, further includes a feeder unit 4 for feeding a sheet 3 into the main casing 2 and an image forming unit 5 for forming an image onto the sheet 3. The main casing 2 has a front cover 2A at its front side.

The feeder unit 4 has a known structure and includes a sheet supply tray 6, a sheet pressing plate 7, and a sheet conveying mechanism 9. In this feeder unit 4, the sheet 3 in the sheet supply tray 6 is pressed upward by the sheet pressing plate 7 to be conveyed by the sheet conveying mechanism 9 to the image forming unit 5.

The image forming unit 5 includes a scanner unit 16, a process cartridge 17, and a fixing unit 18.

The scanner unit 16 includes a laser beam emitting portion, a polygon mirror, a lens, and a reflecting mirror, all of which are not illustrated. In the scanner unit 16, a laser beam travels a path indicated by a chain double-dashed line of FIG. 1 to be irradiated onto a surface of a photosensitive drum 27 at high speed.

The process cartridge 17 can be detached from and attached to the main casing 2 by opening as needed the front cover 2A of the main casing 2. The process cartridge 17 mainly includes a developing cartridge 28 and a drum unit 51.

The developing cartridge 28 is detachable from and attachable to the main casing 2 through the drum unit 51. Alternatively, the developing cartridge 28 is detachable from and attachable to the drum unit 51 fixed to the main casing 2. The developing cartridge 28 mainly includes a developing roller 31, a layer thickness regulating blade 32, a toner supply roller 33, and a toner hopper 34.

In the developing cartridge 28, toner accommodated in the toner hopper 34 is agitated by an agitator 34A, and is thereafter supplied to the developing roller 31 by the toner supply roller 33. At this time, the toner is tribo-charged to have positive polarity between the toner supply roller 33 and the developing roller 31. The toner supplied onto the developing roller 31 enters between the layer thickness regulating blade 32 and the developing roller 31 in association with a rotation of the developing roller 31, and is then carried on the developing roller 31 as a thin layer having a uniform thickness while being further tribo-charged.

The drum unit 51 includes a known photosensitive drum 27, a scorotron charger 29, and a transfer roller 30. In the drum unit 51, a surface of the photosensitive drum 27 is uniformly and positively charged by the scorotron charger 29, and then exposed to a laser beam emitted from the scanner unit 16 by high-speed scanning. Accordingly, an electric potential of the exposed area lowers, so that an electrostatic latent image based on image data is formed.

Further, as the developing roller 31 rotates, the toner carried on the developing roller 31 is supplied to the electrostatic latent image formed on the surface of the photosensitive drum 27. As a result, a toner image is formed on the surface of the photosensitive drum 27. Thereafter, while the sheet 3 is conveyed between the photosensitive drum 27 and the transfer roller 30, the toner image carried on the surface of the photosensitive drum 27 is transferred onto the sheet 3.

The fixing unit 18 has a known structure and includes a heat roller 41 and a pressure roller 42. In the fixing unit 18, the toner image transferred onto the sheet 3 is thermally fixed onto the sheet 3 while the sheet 3 passes between the heat roller 41 and the pressure roller 42. The sheet 3 onto which the toner image has been thermally fixed is conveyed onto a discharger tray 46 by a discharge roller 45.

Next, a configuration for detecting conditions and types of the developing cartridge 28 will be described in detail.

<Configuration of Developing Cartridge>

Figure 2A:
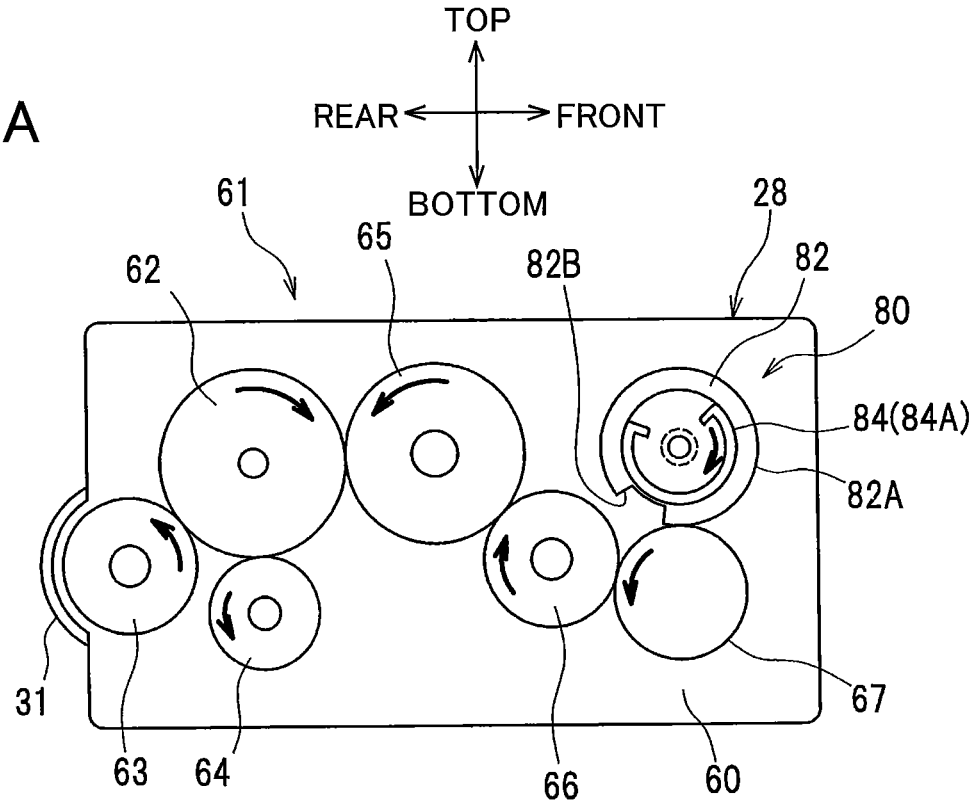
FIG. 2A is a side view of a developing cartridge with a large capacity.

As illustrated in FIG. 2A, the developing cartridge 28 has a casing 60, in addition to the above-described developing roller 31 and the like. The casing 60 has a left side wall at which a gear mechanism 61 and a rotatable body 80 are rotatably provided. The gear mechanism 61 is adapted to transmit a drive force to the developing roller 31. The rotatable body 80 is connected to the gear mechanism 61 (more specifically, an agitator drive gear 66 to be described later) through a transmission gear 67. A cover body (not illustrated) covering the gear mechanism 61 and the rotatable body 80 is attached to the casing 60.

The gear mechanism 61 includes an input gear 62, a developing roller drive gear 63, a supply roller drive gear 64, and the agitator drive gear 66. The input gear 62 is adapted to receive a drive force from a motor 110 (see FIG. 1) provided in the main casing 2. The developing roller drive gear 63 and the supply roller drive gear 64 are adapted to directly engage with the input gear 62. The agitator drive gear 66 is adapted to engage with the input gear 62 through an intermediate gear 65.

The developing roller drive gear 63 is a gear for driving the developing roller 31 (see FIG. 1) and integrally provided at an end portion of a shaft of the developing roller 31. The supply roller drive gear 64 is a gear for driving the toner supply roller 33 (see FIG. 1) and integrally provided at an end portion of a shaft of the toner supply roller 33. The agitator drive gear 66 is a gear for driving the agitator 34A (see FIG. 1) and integrally provided at an end portion of a shaft of the agitator 34A.

The rotatable body 80 is adapted to engage with the transmission gear 67 and to rotate in a clockwise direction in FIG. 2A only by a predetermined angle (distance). More specifically, the rotatable body 80 includes a tooth lacking gear portion 82 and a detection protrusion 84.

The tooth lacking gear portion 82 is a disk-shaped gear and has, at a part of an outer peripheral surface thereof, a gear tooth portion 82A engageable with the transmission gear 67.

The remaining portion of the outer peripheral surface of the tooth lacking gear portion 82 at which the gear tooth portion 82A is absent serves as a tooth lacking portion 82B that is not brought into contact with the transmission gear 67.

The detection protrusion 84 has a generally C-shape and extends outward in the rightward/leftward direction from a left side surface of the tooth lacking gear portion 82. The detection protrusion 84 has an outer peripheral surface 84A. In a state where the rotatable body 80 is supported to the casing 60, the detection protrusion 84 protrudes outward in the rightward/leftward direction from the cover member (not illustrated) covering the gear mechanism 61 and the rotatable body 80 so as to allow the outer peripheral surface 84A to abut against a detection arm 122 (described later). The outer peripheral surface 84A of the detection protrusion 84 is formed in an arcuate shape whose center coincides with a rotation center of the rotatable body 80.

When the developing cartridge 28 is new and the new developing cartridge 28 is mounted in the main casing 2, the detection protrusion 84 is disposed at a position where the outer peripheral surface 84A contacts a leading end of the detection arm 122 (described later) (see FIG. 4A). This allows an optical sensor 121 (described later) to output an ON signal to start detection of the detection protrusion 84 at the time of starting driving of the motor 110, thereby allowing a type of the developing cartridge 28 to be determined during acceleration of the motor 110.

Figure 2B:
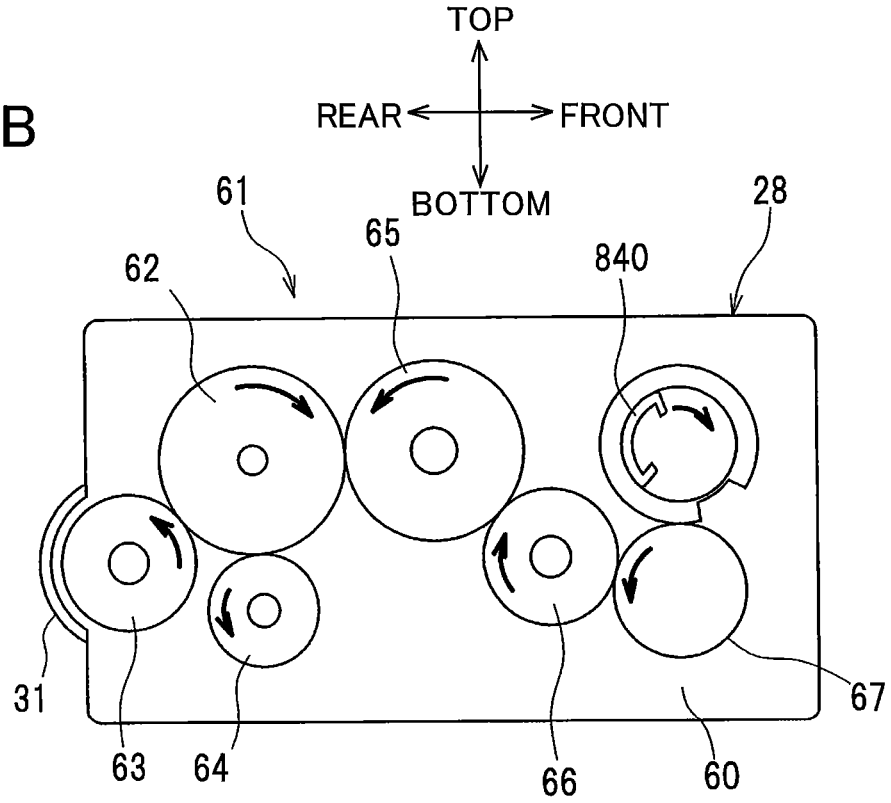
FIG. 2B is a side view of a developing cartridge with a small capacity.

The detection protrusion 84 differs in length in a rotation direction (moving direction) depending on a toner capacity of the developing cartridge 28. More specifically, a developing cartridge 28 for which a maximum number of pages of image formation is set to 6,000 sheets (large capacity) has a detection protrusion 84 whose length in the rotation direction is long as illustrated in FIG. 2A; on the other hand, a developing cartridge 28 for which a maximum number of pages of image formation is set to 3,000 sheets (small capacity) has a detection protrusion 840 whose length in the rotation direction is shorter than that of the detection protrusion 84 of the large-capacity developing cartridge 28 as illustrated in FIG. 2B.

The length in the rotation direction of the detection protrusion 84 is formed in a size such that detection of the detection protrusion 84 by a detection unit 120 (described later) is completed during acceleration of the motor 110 from a start of idle rotation to immediately before a target speed of the motor 110 is reached. In the present embodiment, the motor 110 is accelerated at a constant accelerating gradient to its target speed (see FIG. 6A).

<Configuration of Detection Unit>

Figure 3:
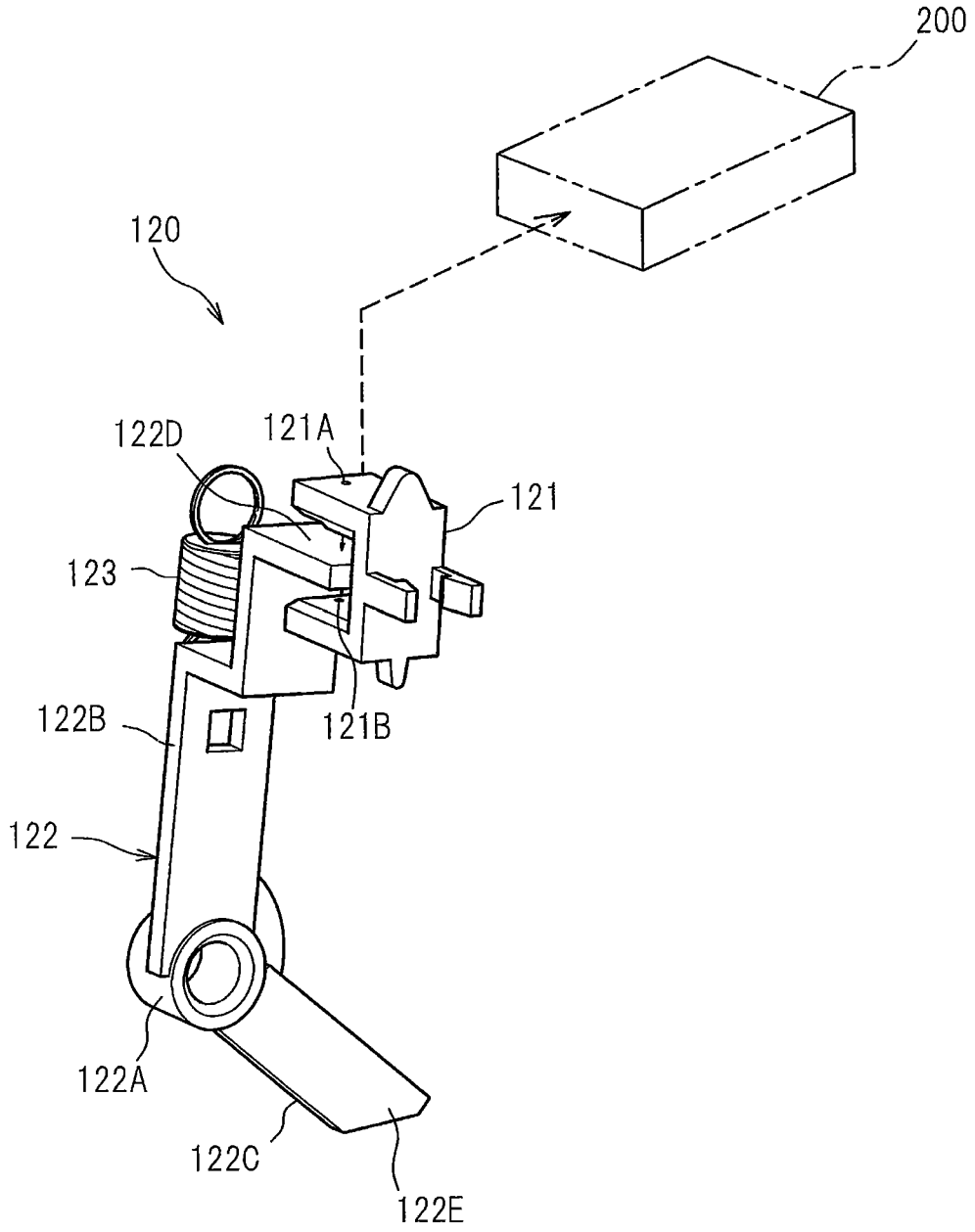
FIG. 3 is a perspective view of a detection unit.
Figure 4A:
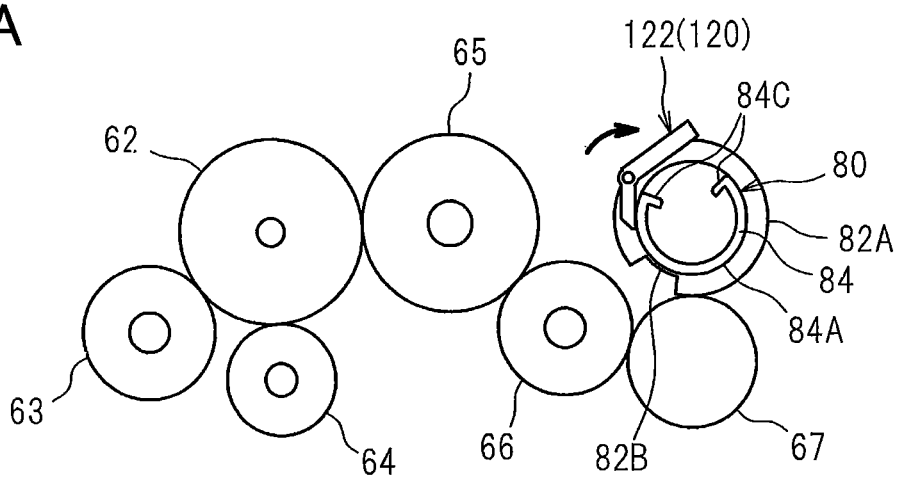

In the main casing 2, the detection unit 120 for detecting the detection protrusion 84 is provided (see FIGS. 3 and 4A). The detection unit 120 includes the optical sensor 121, the detection arm 122, and a coil spring 123.

The optical sensor 121 includes a light emitting portion 121A and a light receiving portion 121B which are disposed opposite to each other. The optical sensor 121 is adapted to output an ON signal when there is no object that intercepts the light path between the light emitting portion 121A and the light receiving portion 121B.

The detection arm 122 includes a cylindrical portion 122A, a light shielding arm 122B, and an abutting arm 122C. The cylindrical portion 122A is rotatably supported to the main casing 2. The light shielding arm 122B and the abutting arm 122C extend outward in a radial direction of the cylindrical portion 122A. The detection arm 122 is adapted to be pivotally moved about the cylindrical portion 122A.

The coil spring 123 is connected to an appropriate portion of the light shielding arm 122B of the detection arm 122. Thus, the detection arm 122 is urged by the coil spring 123 so as to be located at a non-detection position at all times (see FIGS. 3 and 4C).

When the detection arm 122 is located at the non-detection position, a leading end portion 122D of the light shielding arm 122B is positioned between the light emitting portion 121A and the light receiving portion 121B. Further, when the detection arm 122 is located at the non-detection position, a leading end portion 122E of the abutting arm 122C is located at a position where the leading end portion 122E is abuttable against the detection protrusion 84 protruding from an outer surface of the developing cartridge 28 mounted in the main casing 2.

When the developing cartridge 28 is mounted in the main casing 2 to cause the detection protrusion 84 to abut against the leading end portion 122E of the abutting arm 122C, the detection aim 122 is pivotally moved in the clockwise direction in FIG. 3 to be disposed at a detection position (see FIG. 4A), thereby causing the leading end portion 122D of the light shielding arm 122B to be retracted from a position between the light emitting portion 121A and the light receiving portion 121B.

<Configuration of Control Device>

Figure 5:
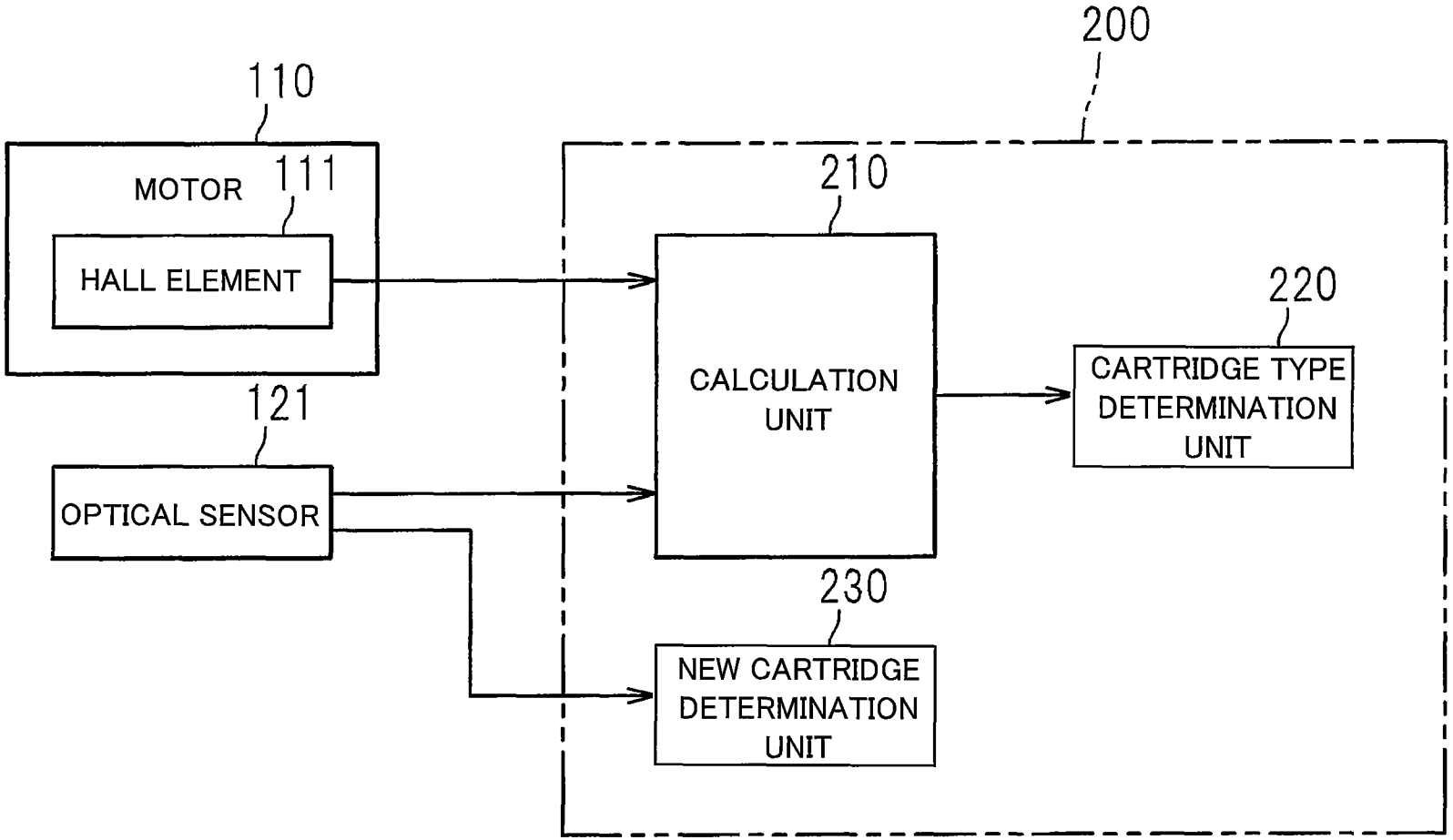
FIG. 5 is a block diagram showing a structure of a control device.

As illustrated in FIG. 5, a control device 200 is provided in the main casing 2. The control device 200 is configured to determine whether the developing cartridge 28 mounted in the main casing 2 is new or used based on the output from the motor 110 and the output from the optical sensor 121, and also configured to determine the type of the developing cartridge 28 mounted in the main casing 2 based on the output from the motor 110 and the output from the optical sensor 121.

The control device 200 includes a CPU, a ROM, and a RAM. The control device 200 is adapted to control the motor 110 provided in the main casing 2 and to execute the known idle rotation when the front cover 2A is closed or the laser printer 1 is powered on. The control device 200 further includes a calculation unit 210, a cartridge type determination unit 220, and a new cartridge determination unit 230.

The calculation unit 210 is adapted to calculate a rotation amount of the motor 110 during a time when the optical sensor 121 detects the detection protrusion 84 based on a detection result outputted from the optical sensor 121 and a detection result outputted from a hall element 111 provided in the motor 110.

Figure 6A:
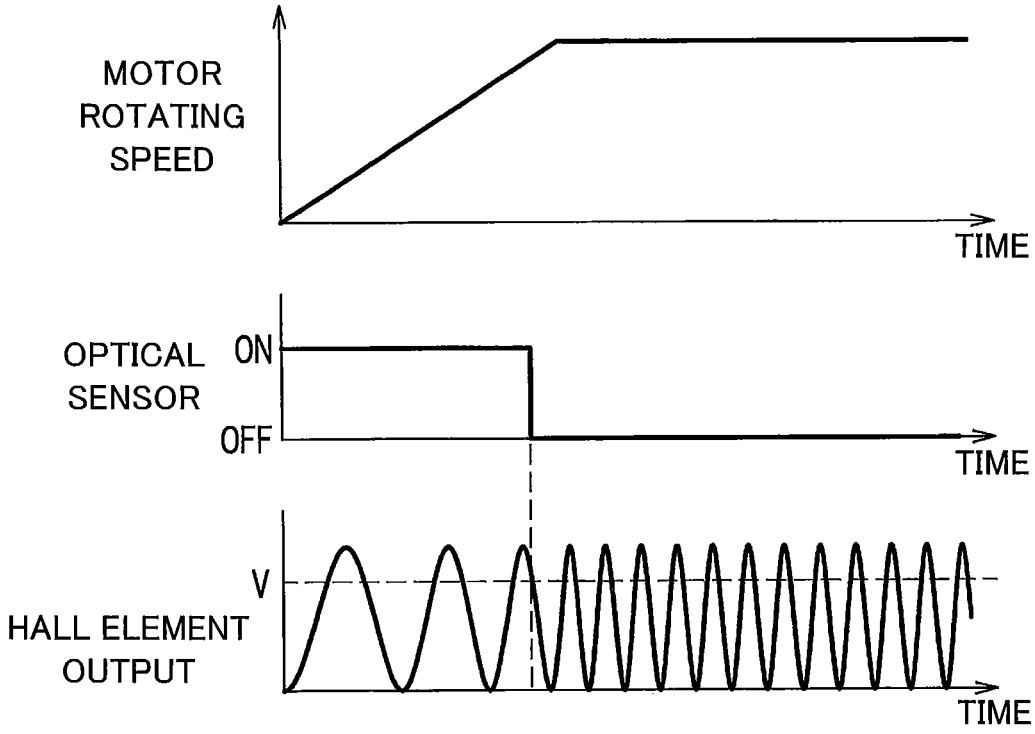

The hall element 111 is a known sensor. In this case, a plurality of hall elements 111 is provided at a position adjacent to a rotor of the motor 110 so as to detect a position of the rotor. More specifically, during rotation of the motor 110, the plurality of hall elements 111 outputs a waveform signal as illustrated in FIG. 6A, and the rotation amount of the motor 110 is represented by the number (peak number) of times that the signal exceeds a predetermined threshold value V. That is, the calculation unit 210 is adapted to calculate the number of times that the signal outputted from the plurality of hall elements 111 exceeds the predetermined threshold value V as the rotation amount of the motor 110.

The cartridge type determination unit 220 is adapted to determine the type of the developing cartridge 28 based on the rotation amount of the motor 110 calculated by the calculation unit 210. More specifically, when the number of times that the signal outputted from the plurality of hall elements 111 exceeds the predetermined threshold value V is equal to or greater than a predetermined number of times, the cartridge type determination unit 220 determines that the developing cartridge 28 is a large-capacity developing cartridge 28. On the other hand, when the number of times that the signal outputted from the plurality of hall elements 111 exceeds the predetermined threshold value V is less than the predetermined number of times, the cartridge type determination unit 220 determines that the developing cartridge 28 is a small-capacity developing cartridge 28. In the present embodiment, the predetermined number of times is set to two.

The new cartridge determination unit 230 determines that the developing cartridge 28 is a new cartridge when the optical sensor 121 has detected the detection protrusion 84. On the other hand, the new cartridge determination unit 230 determines that the developing cartridge 28 is a used cartridge when the optical sensor 121 has not detected the detection protrusion 84.

Next, a movement of the rotatable body 80 when the developing cartridge 28 is mounted in the main casing 2, an operation of the detection unit 120, and an operation of the control device 200 will be described.

When the new developing cartridge 28 is mounted in the main casing 2, the detection protrusion 84 of the rotatable body 80 is brought into abutment with a lower end portion of the detection arm 122 (i.e. the leading end portion 122E of the abutting arm 122C), as illustrated in FIG. 4A. Then, the detection arm 122 is pressed by the detection protrusion 84 with the result that the lower end portion of the detection arm 122 moves rearward together with the detection protrusion 84 (developing cartridge 28).

When the detection arm 122 is pivotally moved in this manner, the detection arm 122 is then disposed at the detection position. Accordingly, the ON signal is outputted from the optical sensor 121 to the calculation unit 210 and the new cartridge determination unit 230 of the control device 200. As a result, the new cartridge determination unit 230 determines that the developing cartridge currently being mounted in the main casing 2 is new.

Figure 4B:
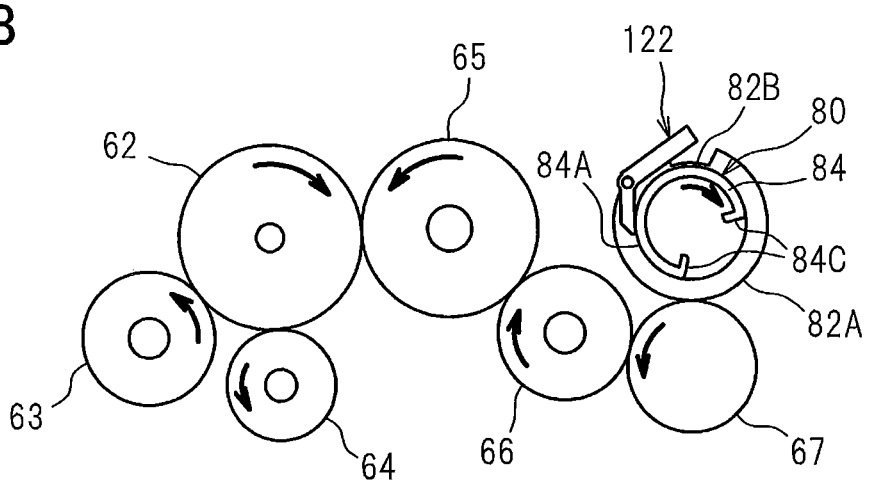

Thereafter, the known idle rotation is executed by the control device 200, and the motor 110 starts rotating in an accelerated manner. Then, as illustrated in FIG. 4B, a drive force of the motor 110 is transmitted to the rotatable body 80 through the input gear 62, the intermediate gear 65, the agitator drive gear 66, and the transmission gear 67, causing the rotatable body 80 to rotate in the clockwise direction.

At this time, since the outer peripheral surface 84A of the detection protrusion 84 of the rotatable body 80 is formed in an arcuate shape whose center coincides with the rotation center of the rotatable body 80, the detection arm 122 does not return to its original position (i.e. non-detection position) as long as the detection arm 122 is supported by the outer peripheral surface 84A of the detection protrusion 84. While the detection arm 122 is thus maintained at the detection position, the ON signal continues to be outputted from the optical sensor 121 to the calculation unit 210 of the control device 200. That is, the optical sensor 121 has been in an ON state.

Figure 4C:
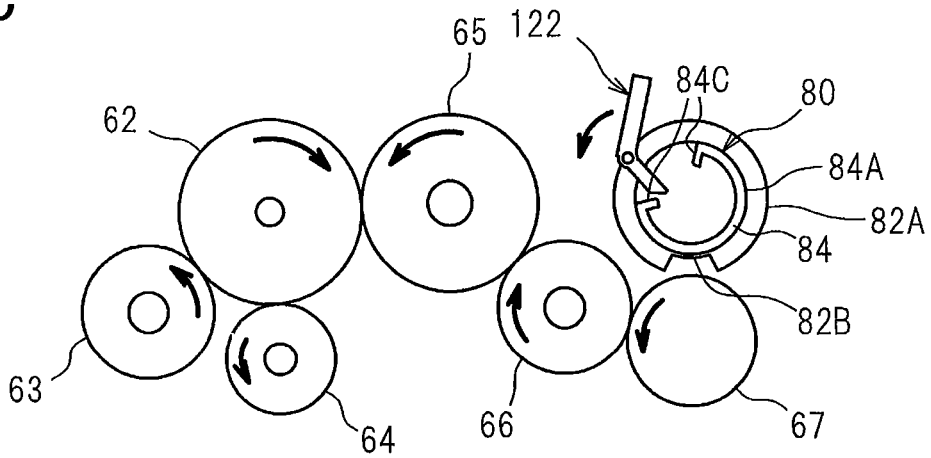

Thereafter, as illustrated in FIG. 4C, when an opening of the generally C-shaped detection protrusion 84 (an opening formed between both end portions 84C of the detection protrusion 84) reaches the lower end portion of the detection arm 122, support of the detection arm 122 by the detection protrusion 84 is released, with the result that the detection arm 122 is set back to the non-detection position by the coil spring 123. Further, at this time, the gear tooth portion 82A of the rotatable body 80 is disengaged from the transmission gear 67 to stop the rotation of the rotatable body 80. At this time point when the rotation of the rotatable body 80 is stopped, the motor 110 is still being accelerated.

Then, when the detection arm 122 is set back to the non-detection position as described above, the light shielding arm 122B of the detection arm 122 returns to its original position to intercept light emitted from the light emitting portion 121A to bring the optical sensor 121 to an OFF state, with the result that output of the ON signal to the control device 200 is stopped.

When the ON signal outputted from the optical sensor 121 is stopped, i.e. when the optical sensor 121 is switched from the ON state to the OFF state, the calculation unit 210 calculates the rotation amount of the motor 110 during the time when the calculation unit 210 receives the ON signal from the optical sensor 121, and the cartridge type determination unit 220 determines the type of the developing cartridge 28 currently being mounted in the main casing 2 based on a result of the calculation.

More specifically, as illustrated in FIG. 6A, in a case where the calculation unit 210 has calculated "3" as the number of times that the signal outputted from the plurality of hall elements 111 exceeds the predetermined threshold value V during a time from the ON state to the OFF state of the optical sensor 121 after the start of the idle rotation (i.e., start of the rotation of the motor 110), the cartridge type determination unit 220 determines that a large-capacity developing cartridge 28 has been mounted in the main casing 2.

Figure 6B:
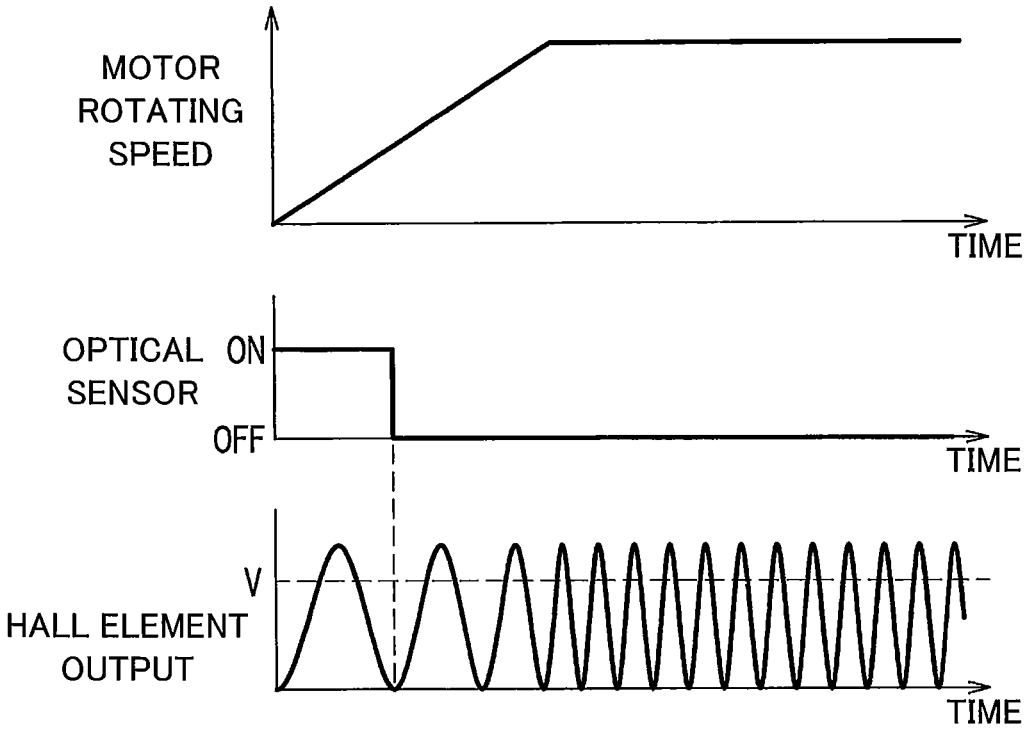

Further, as illustrated in FIG. 6B, in a case where the calculation unit 210 has calculated "1" as the number of times that the signal outputted from the plurality of hall elements 111 exceeds the predetermined threshold value V during a time from the ON state to the OFF state of the optical sensor 121 after the start of the idle rotation (i.e., start of the rotation of the motor 110), the cartridge type determination unit 220 determines that a small-capacity developing cartridge 28 has been mounted in the main casing 2.

As described above, the cartridge type determination unit 220 determines the type of the developing cartridge 28 based on the rotation amount of the motor 110 calculated by the calculation unit 210, i.e., the number of times that the signal outputted from the plurality of hall elements 111 exceeds the predetermined threshold value V calculated by the calculation unit 210, so that even if the laser printer 1 is used under a low-temperature environment to cause a variation in acceleration of the motor 110, the type of the developing cartridge 28 can be determined correctly during acceleration of the motor 110.

Figure 7:
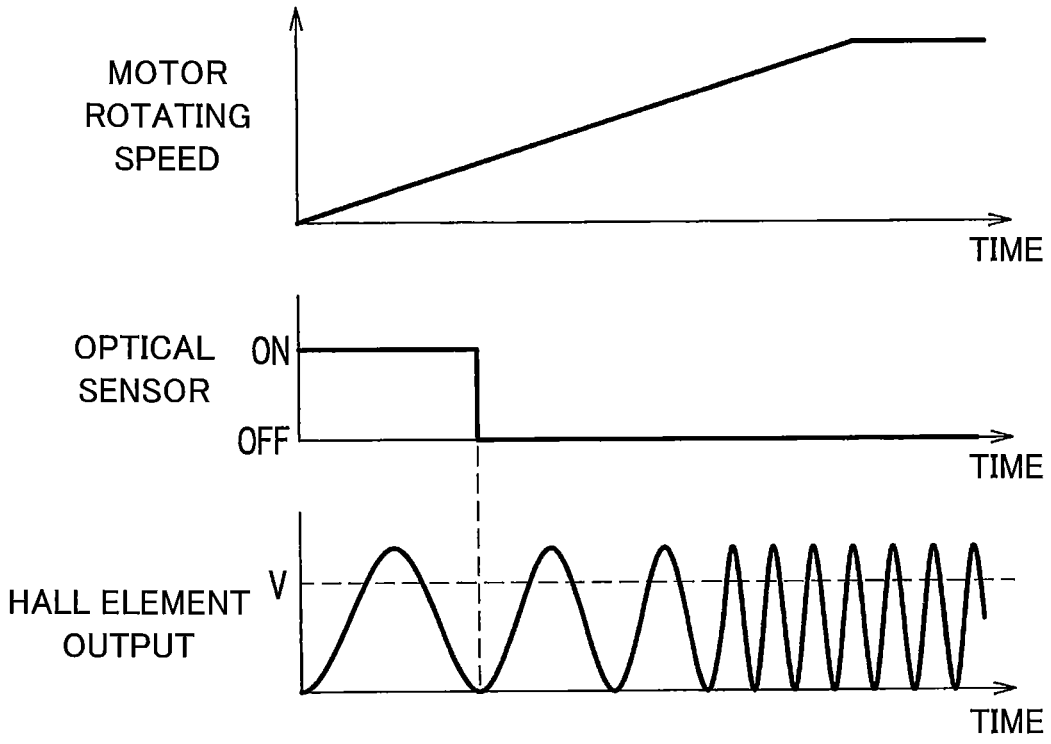
FIG. 7 is an explanatory view showing the rotating speed of the motor, the ON/OFF state of the optical sensor and the output of the plurality of hall elements at the time of the idle rotation when the developing cartridge with a small capacity is mounted in the main casing of the laser printer in a case where a time length from a start of a motor drive to a time at which a rotating speed of the motor becomes constant is longer than usual.

More specifically, as illustrated in FIG. 7, in a case where a time length required for the motor 110 to reach its target speed is longer than usual, that is, acceleration of the motor 110 is low, the optical sensor 121 outputs the ON signal for a longer time than usual (see FIG. 6B) as shown in FIG. 7 even in the same small-capacity developing cartridge 28 due to slow rotation of the rotatable body 80. When the type of the developing cartridge 28 is determined based on the time length of the ON signal as has been done in the conventional image forming apparatus in the case where the time length during which the optical sensor 121 is in the ON state is thus increased, correct determination cannot be made. However, in the present embodiment, even if the time length during which the optical sensor 121 outputs the ON signal is increased, the rotation amount of the motor 110 (number of times that the threshold value V is exceeded) during the time when the ON signal is outputted from the optical sensor 121 is not changed, so that the type of the developing cartridge 28 currently being mounted in the main casing 2 can be reliably determined (as "small capacity" in the case of FIG. 7).

Thus, the following advantageous effects can be obtained in the present embodiment.

The type of the developing cartridge 28 is determined not based on the time length during which the optical sensor 121 detects the detection protrusion 84 as has been done in the conventional image forming apparatus but based on the rotation amount of the motor 110 during the time when the optical sensor 121 detects the detection protrusion 84. Accordingly, even if the optical sensor 121 is designed to detect the detection protrusion 84 during acceleration of the motor 110, the type of the developing cartridge 28 can be determined correctly. As a result, a time required for determining the type of the developing cartridge 28 can be reduced, compared to a configuration in which the detection protrusion 84 is detected after acceleration of the motor 110 is completed.

Detection of the detection protrusion 84 by the detection unit 120 is completed during acceleration of the motor 110, thereby reducing further the time required for determining the type of the developing cartridge 28.

Modifications of Embodiment

Various modifications are conceivable.

Figure 8:
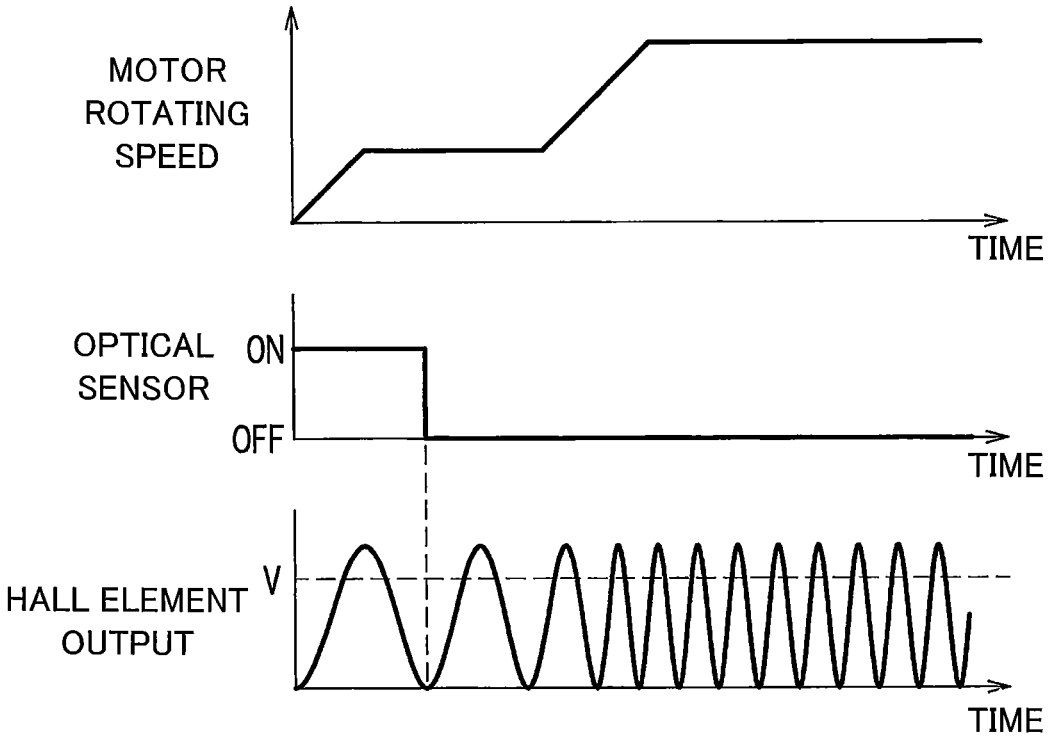
FIG. 8 is an explanatory view showing a rotating speed of a motor, an ON/OFF state of an optical sensor and an output of a plurality of hall elements at the time of an idle rotation when a developing cartridge with a small capacity is mounted in a main casing of a laser printer according to a modification.

Although the motor 110 is accelerated at a constant rate to its target speed in the above-described embodiment, the present invention is not limited to this. For example, as illustrated in FIG. 8, a configuration may be possible in which the motor is accelerated to a second target speed lower than a first target speed (speed at print control time), maintained at this second target speed for a predetermined time, and then accelerated once again to the first target speed. This can reduce a peak current of the motor.

Even with such a configuration, the rotation amount of the motor 110 (number of times that the threshold value V is exceeded) during the time when the optical sensor 121 outputs the ON signal is constant irrelevant of whether the motor 110 is accelerated or driven at a constant speed. Hence, the type of the developing cartridge 28 currently being mounted in the main casing 2 can be reliably determined (as "small capacity" in the case of FIG. 8).

Although in the above-described embodiment the developing cartridge 28 is exemplified as a cartridge, the present invention is not limited to this, but the cartridge may be the drum unit 51 or the process cartridge 17.

In the above-described embodiment, the detection protrusion 84 is exemplified as a detected portion, and the optical sensor 121 outputs the ON signal during a time when the detection unit 120 has been detected the detection protrusion 84. However, the present invention is not limited to this. For example, a concave portion may be formed in a peripheral surface of a cylindrical rotatable body and used as the detected portion. In this case, the signal outputted from the optical sensor 121 during a time when the detection unit 120 has been detected the detected portion is an OFF signal.

Although in the above-described embodiment the hall element 111 is exemplified as a rotation amount detection unit, the present invention is not limited to this. For example, as the rotation amount detection unit, a known FG (flux-gate) sensor provided in the motor 110 or a sensor for indirectly detecting the rotation amount of the motor 110 (e.g., an encoder for detecting the rotation amount of a gear) may be available.

Although a difference in capacity of the developing cartridges 28 is exemplified as the cartridge type to be determined by the cartridge type determination unit 220 in the above-described embodiment, the present invention is not limited to this. For example, the cartridge type determination unit 220 may be designed to determine a color of the toner accommodated in the developing cartridge 28 or to determine whether the toner accommodated in the developing cartridge 28 is pulverized toner or polymerized toner.

Although the detection protrusion 84 (detected portion) is detected based on the ON/OFF state of the optical sensor 121 of the detection unit 120 in the above-described embodiment, the present invention is not limited to this.

For example, the detection unit may include a control device, and an electrode provided in the main casing. In this case, the control device detects whether electrical connection between the electrode and an electrode provided in the developing cartridge 28 is provided or interrupted to thereby detect the detected portion. More specifically, the electrode of the detection unit provided in the main casing 2 (hereinafter referred to as main casing-side electrode) is urged toward the electrode provided in the developing cartridge 28 (hereinafter referred to as cartridge-side electrode) so as to be electrically connected thereto. The detected portion, which is formed of an insulating material, moves between the cartridge-side electrode and the main casing-side electrode to move the main casing-side electrode away from the cartridge-side electrode so as to interrupt the electrical connection between the main casing-side electrode and the cartridge-side electrode while the detected portion is moving between the cartridge-side electrode- and the main casing-side electrode. This allows the control device to detect the detected portion based on the electrical connection/non-electrical connection between the main casing-side electrode and the cartridge-side electrode.

While the present invention has been described in detail with reference to the embodiment thereof, it would be apparent to those skilled in the art that various changes and modifications may be made therein without departing from the spirit of the present invention.

What is claimed is:

1. An image forming apparatus comprising:

a cartridge including a movable member provided with a detected portion, the movable member being configured to move in a moving direction and by a predetermined moving amount, wherein the cartridge is configured to accommodate developer therein, and wherein the detected portion has a length in the moving direction that differs depending on an amount of developer accommodated in the cartridge;

a drive source configured to generate a rotation as a drive force and configured to transmit the drive force to the movable member, the drive source including a rotation amount detection unit configured to detect a rotation amount of the drive source and configured to output a first detection result;

a detection unit configured to detect the detected portion and configured to output a second detection result; and a control device configured to execute:

a calculation process configured to calculate the rotation amount of the drive source during a time period of detecting the detected portion based on the first detection result and the second detection result; and a cartridge type determination process configured to determine a type of the cartridge based on the calculated rotation amount.

2. The image forming apparatus as claimed in claim 1, wherein the control device is further configured to execute a new cartridge determination process configured to determine that the cartridge is a new cartridge if the detection unit has detected the detected portion.

3. The image forming apparatus as claimed in claim 1, wherein the movable member is configured to move exclusively in one moving direction.

4. The image forming apparatus as claimed in claim 1, wherein the detection unit is configured to terminate the detection of the detected portion during acceleration of the drive source.

5. The image forming apparatus as claimed in claim 1, further comprising a main casing, the cartridge being configured to be detachably mounted in the main casing.

6. The image forming apparatus as claimed in claim 5, wherein the control device is further configured to execute a new cartridge determination process configured to determine that the cartridge is a new cartridge if the detection unit has detected the detected portion.

7. The image forming apparatus as claimed in claim 5, wherein the movable member is configured to move exclusively in one moving direction.

8. The image forming apparatus as claimed in claim 5, wherein the detection unit terminates the detection of the detected portion during acceleration of the drive source.

9. An image forming apparatus comprising:

a cartridge including a movable member provided with a detected portion, the movable member being configured to move in a moving direction and by a predetermined moving amount, wherein the cartridge is configured to accommodate developer therein, and wherein the detected portion has a length in the moving direction that differs depending on an amount of developer accommodated in the cartridge;

a drive source configured to generate a rotation as a drive force and configured to transmit the drive force to the movable member;

a detection unit configured to detect the detected portion and configured to output a first detection result;

a rotation amount detection unit configured to detect a rotation amount of the drive source and configured to output a second detection result; and a control device configured to execute:

a calculation process configured to calculate the rotation amount of the drive source during a time period of detecting the detected portion based on the first detection result and the second detection result; and a cartridge type determination process configured to determine a type of the cartridge based on the calculated rotation amount.

10. The image forming apparatus as claimed in claim 9, wherein the control device is further configured to execute a new cartridge determination process configured to determine that the cartridge is a new cartridge if the detection unit has detected the detected portion.

11. The image forming apparatus as claimed in claim 9, wherein the movable member is configured to move exclusively in one moving direction.

12. The image forming apparatus as claimed in claim 9, wherein the detection unit is configured to terminate the detection of the detected portion during acceleration of the drive source.

13. The image forming apparatus as claimed in claim 9, further comprising a main casing, the cartridge being configured to be detachably mounted in the main casing.

14. The image forming apparatus as claimed in claim 13, wherein the control device is further configured to execute a new cartridge determination process configured to determine that the cartridge is a new cartridge if the detection unit has detected the detected portion.

15. The image forming apparatus as claimed in claim 13, wherein the movable member is configured to move exclusively in one moving direction.

16. The image forming apparatus as claimed in claim 13, wherein the detection unit terminates the detection of the detected portion during acceleration of the drive source.

* * * * *